US005382386A

United States Patent [19]

Jakubicki et al.

[11] Patent Number: 5,382,386

[45] Date of Patent: Jan. 17, 1995

[54] CROSSLINKED ALKYL VINYL ETHER/MALIC ANHYDRIDE COPOLYMER

[75] Inventors: Gary J. Jakubicki, Robbinsville; Carl R. Schwarz, Lincroft; Alp J. Uray, Piscataway, all of N.J.

[73] Assignee: Colgate Palmolive Co., Piscataway, N.J.

[21] Appl. No.: 32,949

[22] Filed: Mar. 17, 1993

Related U.S. Application Data

[63] Continuation of Ser. No. 691,668, Apr. 25, 1991, abandoned, which is a continuation-in-part of Ser. No. 616,497, Nov. 21, 1990, abandoned.

[51] Int. Cl.[6] ..... C11D 1/22

[52] U.S. Cl. ..... 252/548; 252/544; 252/553

[58] Field of Search ..... 252/153, 170, 173, 544, 252/553, DIG. 14, 548

[56] References Cited

U.S. PATENT DOCUMENTS 4,671,894 6/1987 Lamb et al. ..... 252/548

5,096,622 3/1992 Simion et al. ..... 252/548

*Primary Examiner*—Gary P. Straub

*Assistant Examiner*—Stuart L. Hendrickson

*Attorney, Agent, or Firm*—Richard E. Nanfeldt; Bernard Lieberman; Robert Sullivan

[57] ABSTRACT

A process for the manufacture of a concentrated liquid detergent composition containing over 40% solid ingredients including magnesium alkylbenzene sulfonate and an alkanolamide component, offers reduction in viscosity during manufacture and upon cooling of the composition. The addition of salts and hydrotropes to the concentrated liquid detergent composition and the incorporation of alkanolamide prior to the addition of alkylbenzene sulfonic acid sufficiently lowers the viscosity of the mixture to allow processing under conventional mixing conditions.

5 Claims, No Drawings

CROSSLINKED ALKYL VINYL ETHER/MALIC ANHYDRIDE COPOLYMER

This application is a continuation of application No. 07/691,668, filed Apr. 25, 1991, now abandoned which is a continuation-in-part of 07/616,497 filed Nov. 21, 1993 now abandoned.

BACKGROUND OF THE INVENTION

1. Field Of The Invention

The present invention relates to a process for producing concentrated liquid detergent compositions containing the magnesium salt of alkyl benzene sulfonic acid and a suds boosting alkanolamide component, and which compositions have decreased viscosity during manufacture and upon cooling.

2. Description Of The Prior Art

Typical liquid dishwashing detergents contain substantial amounts of anionic surfactants that help provide greasy soil removal. Generally, the grease cutting ability of the composition increases with an increased concentration of surfactants; however, the viscosity of compositions containing concentrations of anionic surfactants of about 30–50% is potentially problematic in the manufacture of such compositions, particularly as the surfactant levels of such compositions approach 50%.

The viscosity of a liquid detergent composition is affected by the concentration of anionic surfactant components as well as all other solid ingredients. The word "solid" is used herein to refer to all ingredients other than solvents and thus may include normally liquid ingredients. A viscosity of about 12,000 cps renders a composition thick and paste-like and is thus extremely difficult to mix.

It is sometimes desirable in manufacturing liquid detergents to make a base composition separately from the finished product. The base composition contains appropriate amounts of the surfactant active ingredients such as, for example, magnesium alkylbenzene sulfonate, alkyl sulfate and alkyl ethoxy sulphate; suds boosting agents such as, for example, alkyl mono- or di-alkanolamide; and a liquid carrier such as, for example water, a water soluble solvent or mixtures of water and a water-soluble solvent. The base composition may be diluted to form the desired final liquid detergent product composition with other aqueous or aqueous-alcohol solutions containing ingredients such as, for example, hydrotropes, to provide phase stability and lower the viscosity of the composition, alkali metal salts such as, for example, magnesium sulfate or sodium sulfate to boost detergency; minor ingredients such as, for example, opacifying agents; color stabilizers; dyes; perfumes; heavy metal chelating agents; antioxidants; antimicrobial agents; etc.; and pH modifying bases and acids such as, for example, NaOH and HCl. Examples of hydrotropes include, but are not limited to, urea, $C_2$–$C_4$ alcohols, sodium xylene sulfonate, potassium xylene sulfonate, sodium cumene sulfonate, ammonium xylene sulfonate and the like. Such base compositions may contain higher concentrations of surfactants and other solid ingredients than the final liquid detergent product composition and as such, the viscosities of such compositions may require expensive and high energy mixing devices during manufacture and may cause the compositions to gel at ambient temperature.

In U.S. Pat. No. 4,169,076 a method is disclosed for making a pre-neutralized base solution of the magnesium salt of an anionic active agent which can be directly utilized in the production of liquid detergent. Similarly, U.S. Pat. No. 4,129,515 discloses a process for producing a heavy-duty liquid detergent base composition wherein an anionic surfactant in the free acid form is mixed with magnesium hydroxide to provide an acid solution that is later neutralized with alkanolamine.

It is accordingly an object of this invention to provide a process for the manufacture of concentrated liquid detergent base, useful in the manufacture of concentrated liquid detergents, which comprises magnesium alkylbenzene sulfonate and alkanolamide, and in which the base is made separately from the finished product.

It is another object of this invention to provide a process for the manufacture of concentrated liquid detergent compositions that contain levels of magnesium alkylbenzene sulfonate, alkanolamide or an ethoxylated alkanolamide and other solid (non-solvent) ingredients that otherwise would result in viscosities above about 12,000 cps during manufacture or after cooling and which does not require special heavy duty or high shear mixing devices.

Another object of this invention is to provide a process for the manufacture of concentrated liquid detergent compositions containing at least about 40% solid ingredients including magnesium alkylbenzene sulfonate and a suds boosting agent including an alkanolamide or an ethoxylated alkanolamide and that can be stored at ambient temperature without gelling.

SUMMARY OF THE INVENTION

The present invention encompasses an improvement in the process for preparing a concentrated liquid detergent composition containing the magnesium salt of alkylbenzene sulfonic acid and ethoxylated or non-ethoxylated alkyl mono- or di-substituted alkanolamide as suds boosting agent, alkali metal salts and/or alkali earth metal salts, and hydrotrope. This invention is based upon the discovery that by (1) forming an aqueous mixture containing the suds boosting alkanolamide, alkali metal salts and/or alkali earth metal salts, and hydrotrope in a liquid carrier and (2) adding the alkylbenzene sulfonic acid to said mixture (1) in the order of steps (1), (2) providing that a source of magnesium is supplied in either step (1) or step (2)

the viscosity of the formulation is sufficiently lowered to about 12,000 cps or lower to allow mixing with ordinary low shear mixing devices.

Concentrated liquid detergent compositions prepared according to the foregoing process have decreased viscosity during manufacture and remain pourable upon cooling.

DETAILED DESCRIPTION OF THE INVENTION

According to the present invention, concentrated magnesium alkylbenzene sulfonate-containing compositions comprising a total detersive active ingredients and solid (non-solvent) ingredients level such that the viscosity of the composition during manufacture would be about 12,000 cps or higher if prepared by a process outside the present invention, are prepared by combining suds boosting alkanolamides such as, for example, lauric and myristic monoethanolamides with a mixture containing hydrotropes, alkali metal salts and/or alkaline earth metal salts and, optionally, magnesium oxide or magnesium hydroxide in a liquid carrier, and then adding alkylbenzene sulfonic acid in an amount sufficient to produce a composition having a pH in the range of 2 to 5.

Although useful concentrated liquid detergent compositions prepared according to this invention of necessity contain a liquid carrier, such as water or mixture of water and water-soluble solvents, it is desirable that the amount of carrier be kept to a minimum.

The amount of carrier liquid used herein is preferably chosen to provide a composition containing from about 10 to 50%, preferably 15 to 35%, of carrier by weight of the total detergent composition.

Any alcohol containing from 1 to about 5 carbon atoms can be used in the carrier mixture to prepare detergent compositions in the manner of this invention. For example, methanol, n-propanol, ethanol, n-butanol, isopropanol, isobutanol and pentanol may be used.

Various liquid or low-melting point, water-soluble poly-ols can also be used in the carriers herein. Such materials include, for example, ethylene glycol, polyethylene glycol, glycerins, glycol ethers and the like.

Other water-soluble solvents include, for example, ketones such as acetone; aldehydes such as propionaldehyde; ethers such as diethyl ether as well as various natural water-soluble oils that contain water-soluble organic solvents. The preferred organic solvent carrier is propylene glycol.

The amide suds booster of the compositions prepared in the manner of this invention is preferably added in prill form but may be added in the molten state, alone, or as a blend with another material of the composition such as, for example, a sodium xylene sulfonate solution. The amide suds booster is preferably chosen to provide a composition containing from about 5 to 10% of suds booster by weight of the total detergent composition. The amide may contain ethoxylation to increase its solubility. The alkyl group of the amide may be derived from coconut or palm kernel oil. The alkanol group of the amide may have a carbon chain distribution of $C_1$–$C_5$ and be either mono- or di-substituted. The preferred amide suds booster is lauric/myristic monoethanolamide.

Hydrotrope is added to the composition in the interests of achieving phase stability and decreased viscosity. Hydrotropes such as sodium and potassium toluene sulfonate, sodium and potassium xylene sulfonate, trisodium sulfosuccinate, sodium and potassium cumene sulfonate and related compounds are commonly used in combination or alone. In a preferred embodiment, sodium cumene sulfonate and sodium xylene sulfonate comprise from about 3 to 10 wt. % of the total composition.

A mixture containing salts, hydrotrope, alkanolamide and, optionally magnesium oxide or magnesium hydroxide in a liquid carrier is made and continuously agitated while alkylbenzene sulfonic acid is added. The alkylbenzene sulfonic acid can be either linear or branched. The alkyl group preferably contains 12 to 18 carbon atoms, most preferably 12 to 14 carbon atoms in a linear chain configuration. However, $C_{11}$–$C_{14}$ branched chain alkylbenzene sulfonic acids, which are excellent sudsers, may also be used. The amount of alkylbenzene sulfonic acid added to the mixture is chosen to provide a composition containing from about 30 to 50% alkylbenzene sulfonic acid by weight of the total detergent composition. The alkylbenzene sulfonic acid to be added to the mixture can be prepared by sulfonating alkylbenzene in any known procedure. Typical examples of alkylbenzene sulfonic acids include, for example, undecylbenzene sulfonic acid, dodecylbenzene sulfonic acid, tridecylbenzene sulfonic acid and mixtures thereof.

The acid form of alkylbenzene sulfonic acid can be converted to the magnesium salt form during admixture of the alkylbenzene sulfonic acid with the other ingredients in the liquid carrier or prior to admixture. The conversion may be accomplished by direct neutralization by magnesium hydroxide or by ion exchange between, for example, an alkali metal salt or the ammonium salt of alkylbenzene sulfonate and a water-soluble alkaline earth metal salt. The amount of alkali metal salt and/or alkali earth metal salt is chosen to provide a composition containing from about 1 to 3 wt. % based upon the weight of the total composition. The amount of magnesium oxide or magnesium hydroxide that may optionally be added to the composition ranges from about 2 to 4 wt. %. Preferably, a source of magnesium ions is added to the mixture prior to the addition of alkylbenzene sulfonic acid to form the desired salt of alkylbenzene sulfonic acid. The preferred salt of alkylbenzene sulfonate is magnesium alkylbenzene sulfonate and, most preferably, the alkylbenzene sulfonate is the magnesium salt of linear dodecylbenzene sulfonate.

The order in which the materials are mixed in the liquid carrier affects the viscosity of the composition during manufacture and upon cooling. Significant reductions in viscosity during manufacturing are made by adding salt and hydrotrope solutions to the liquid carrier prior to the addition of alkylbenzene sulfonic acid. Whereas this modification decreases viscosity of the composition during manufacture, it does not prevent the concentrated composition from gelling upon cooling, however. The addition of the alkanolamide to the liquid carrier mixture containing salt and hydrotrope prior to the addition of the alkylbenzene sulfonic acid further reduces the viscosity of the composition during manufacture and prevents the composition from gelling upon cooling. Thus, a composition in which the alkanolamide, salt and hydrotrope are added to a liquid carrier prior to the addition of alkylbenzene sulfonic acid decreases viscosity of the composition during manufacture and results in a concentrated liquid detergent composition that remains fluid after the temperature of the composition has dropped. These modifications in the process for preparing a concentrated liquid detergent composition are particularly significant in that they eliminate the need for specialized mixing equipment and allow for the manufacture of a concentrated liquid detergent composition that can be stored at ambient temperature without gelling.

It is sometimes desirable in the manufacture of concentrated liquid detergent compositions to formulate compositions containing a very high active ingredients content. However, as the level of solid ingredients in the composition increases, the viscosity of the composition also increases. A composition viscosity of over 12,000 cps generally requires special mixing equipment during manufacture and generally the composition is not readily pourable at room temperature. The process of this invention allows manufacture of a more concentrated magnesium alkylbenzene sulfonate containing detergent composition than would be possible without mixture of the alkanolamide, salt and hydrotropes prior to the addition of alkylbenzene sulfonic acid.

Concentrated detergent compositions prepared according to the process of this invention can optionally contain various other components that contribute to aesthetics or performance. Such components can be added to the mixture containing salts, hydrotrope and alkanolamide in liquid carrier prior to the addition of alkylbenzene sulfonic acid but are preferably added after alkylbenzene sulfonic acid has been added to said mixture. Conveniently, the optional ingredients may be added as aqueous or aqueous-alcohol solutions that comprise no more than about 3% by weight of the final composition.

Optional components that may be added to the base compositions prepared herein include, for example, opacifying agents; color stabilizers; dyes; water-soluble pigments; perfumes; heavy metal chelating agents such as EDTA; antioxidants; anti-microbial agents; etc.

EXAMPLE 1

Concentrated liquid detergent compositions are prepared using the following components in the order as listed:

| | Composition 1 | Composition 2 | Composition 3 | Composition 4 | Composition 5 |
|---|---|---|---|---|---|
| | | | Wt. % | | |
| Deionized water | 24.8 | 27.0 | 32.8 | 29.8 | 19.8 |
| Sodium cumene sulfonate (45% sol.) | 4.7 | 5.2 | 4.7 | 5.7 | 5.1 |
| Sodium xylene sulfonate (40% sol.) | 12.0 | 13.0 | 12.0 | 14.4 | 12.8 |
| Propylene glycol | 2.3 | 2.5 | 2.3 | 2.8 | 2.5 |
| Magnesium oxide | 2.7 | 2.9 | 2.7 | 3.2 | 2.8 |
| Sodium sulfate | 1.2 | 1.2 | 1.2 | 1.4 | 1.2 |
| Lauric/myristic monoethanolamide | 8.0 | — | — | — | 8.5 |
| Dodecylbenzene sulfonic acid | 44.3 | 48.2 | 44.3 | 44.7 | 42.7 |
| Total | 100.0 | 100.0 | 100.0 | 100.0 | 100.0 |
| Useful Detergent Active Ingredients (LMMEA + MgLAS) | 54% | 49% | 46.0% | 44.0% | 57.4% |
| Theoretical Solids, % (Non-solvents) | 60.9% | 57.5% | 52.9% | 53.2% | 65.0% |
| Viscosity (Brookfield HA, Spindle 7, 10 rpm) | 8,800 cps | 48,000 cps | 12,000 cps | 48,800 cps | 16,800 cps |

The concentrated liquid detergent compositions of Example 1 are prepared by mixing all of the ingredients, with the exception of dodecylbenzene sulfonic acid, into the water-propylene glycol carrier mixture. The dodecylbenzene sulfonic acid is then added to the mixture.

Compositions 2, 3 and 4, which contain a lower solids concentration and a lower level of detersive active ingredients than Composition 1 but which, by adding docecylbenzene sulfonic acid prior to the addition of alkanolamide, are extremely thick and paste-like during manufacture and require special high shear mixing equipment. Compositions 2 and 4, for example, have a viscosity of almost 50,000 cps at room temperature.

Composition 1, on the other hand, has decreased viscosity during manufacture and remains pourable after the composition has cooled. The viscosity of the composition is less than 10,000 cps.

Composition 5, which is made by the process of this invention and which contains 65% solid ingredients has a high viscosity but shows significant improvement in viscosity and fluidity over Compositions 2 and 4, which contain 8 and 13% less active ingredients, respectively.

This example demonstrates the decreased viscosity of a concentrated liquid detergent composition containing magnesium alkylbenzene sulfonate and manufactured by the process of this invention over similar compositions made by mixing the alkylbenzene sulfonic acid with other ingredients prior to the addition of alkanolamide. Composition 1 is a pourable liquid at 25° C., whereas Compositions 2, 3 and 4 are thick gels at 25° C.

EXAMPLE 2

Concentrated liquid detergent compositions are prepared using the following components in the order as listed:

| | Composition 1 | Composition 2 |
|---|---|---|
| Deionized water | 24.8 | 37.7 |
| Sodium cumene sulfonate (45% sol.) | 4.7 | — |
| Sodium xylene sulfonate (40% sol.) | 12.0 | — |
| Propylene glycol | 2.3 | 2.5 |
| Magnesium oxide | 2.7 | 2.9 |
| Sodium sulfate | 1.2 | — |
| Lauric/myristic monoethanolamide | 8.0 | 8.7 |
| Dodecylbenzene sulfonic acid | 44.3 | 48.2 |
| Total | 100.0 | 100.0 |
| Consistency at 25° C. | Pourable liquid | Thick gel |

After mixing the above listed ingredients, hydrotropes (sodium cumene sulfonate and sodium xylene sulfonate) and sodium sulfate were added to Composition 2 in amounts equal to that in Composition 1. The addition of hydrotropes and salt subsequent to the addition of alkylbenzene sulfonic acid slightly decreased the viscosity of the composition but left it highly aerated and thicker than desirable for manufacture.

This example illustrates that the addition of salt and hydrotropes decreases viscosity of a concentrated liquid detergent composition but that the addition of these ingredients must precede the addition of alkylbenzene sulfonic acid in order to exert the full effect on viscosity.

What is claimed is:

1. A liquid detergent composition which consists of approximately by weight:

(a) 3 to 10% of at least one hydrotrope other than ingredient (d);

(b) 5 to 10% of an alkanolamide;

(c) 22 to 50% of a liquid carrier being selected from the group consisting of water and a mixture of said water and a water-soluble solvent; and (d) 32 to 54% of the reaction product of magnesium compound and a $C_{11}$ to $C_{18}$ alkyl benzene sulfonic acid wherein said composition has a viscosity of less than 20,000 cps and said composition contains at least 40 wt. % of solid ingredients.

2. The composition according to claim 1, wherein said composition has a pH in the range of 2–5.

3. The composition according to claim 1, wherein the alkanolamide is selected from the group consisting of $C_{10}$–$C_{16}$ alkyl monoalkanolamides, $C_1$–$C_5$ dialkanolamides, ethoxylated $C_{10}$–$C_{16}$ alkyl monoalkanolamides, and ethoxylated $C_1$–$C_5$ dialkanolamides and mixtures thereof.

4. The composition according to claim 1, wherein the liquid carrier is water or a mixture of water with a water-soluble solvent selected from the group consisting of ketones, aldehydes, ethers, natural water soluble oils, water-soluble poly-ols, alcohols containing from 1 to about 5 carbon atoms, and mixtures thereof.

5. The composition according to claim 1, wherein the concentration of said (a), (b), and (c) taken together is at least 50% by weight.

* * * * *

UNITED STATES PATENT AND TRADEMARK OFFICE

CERTIFICATE OF CORRECTION

PATENT NO. : 5,382,386

DATED : January 17, 1995

INVENTOR(S) : Gary J. Jakubicki, et. al.

It is certified that error appears in the above-indentified patent and that said Letters Patent is hereby corrected as shown below:

Title page, item [54] and col. 1,

Delete Title in its entirety "Crosslinked Alkyl Vinyl Ether/Malic Anhydride Copolymer"
Insert new Title as follows: --Process for Producing Concentrated Liquid Detergents Containing Magnesium Sulfonic Acid and Alkanolamide--

Signed and Sealed this

Twelfth Day of September, 1995

*Attest:*

Bruce Lehman

BRUCE LEHMAN

*Attesting Officer*

*Commissioner of Patents and Trademarks*